US010989042B2

(12) United States Patent
Lallemand et al.

(10) Patent No.: US 10,989,042 B2
(45) Date of Patent: Apr. 27, 2021

(54) DOWNHOLE TOOL PROTECTION COVER

(71) Applicants: Marco Lallemand, Burgdorf (DE); Stephan Bernard, Dubai (AE); Joern Froehling, Meinersen (DE); Marcus Dissen, Hannover (DE); Kevin Krueger, Hannover (DE)

(72) Inventors: Marco Lallemand, Burgdorf (DE); Stephan Bernard, Dubai (AE); Joern Froehling, Meinersen (DE); Marcus Dissen, Hannover (DE); Kevin Krueger, Hannover (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/820,747

(22) Filed: Nov. 22, 2017

(65) Prior Publication Data

US 2019/0153852 A1 May 23, 2019

(51) Int. Cl.

| | |
|---|---|
| ***E21B 47/017*** | (2012.01) |
| ***E21B 47/12*** | (2012.01) |
| *E21B 33/12* | (2006.01) |

(52) U.S. Cl.

CPC ..... *E21B 47/017* (2020.05); *E21B 47/12* (2013.01); *E21B 33/12* (2013.01)

(58) Field of Classification Search

CPC ..... E21B 41/011; E21B 47/011

See application file for complete search history.

(56) References Cited

U.S. PATENT DOCUMENTS

| | | | |
|---|---|---|---|
| 2,126,405 | A | 8/1938 | Milller |
| 3,343,890 | A | 9/1967 | Homer |
| 3,667,817 | A | 6/1972 | Kellner |
| 4,146,060 | A | 3/1979 | Garrett |
| 4,381,821 | A | 5/1983 | Greene, Jr. |
| 4,445,727 | A | 1/1984 | Funk |

(Continued)

FOREIGN PATENT DOCUMENTS

| | | | |
|---|---|---|---|
| CN | 101581219 | A | 11/2009 |
| WO | 20160004393 | A1 | 1/2016 |

OTHER PUBLICATIONS

Evolution Oil Tools Inc., El Sliding Sleeve, 2014. 1 Page.

(Continued)

*Primary Examiner* — D. Andrews

(74) *Attorney, Agent, or Firm* — Cantor Colburn LLP

(57) ABSTRACT

Systems and methods to cover sensitive areas of downhole tools including a downhole tool having an outer surface including a first position and a second position on the outer surface of the downhole tool, the outer surface having a sensitive area, a downhole sensitive element positioned along the outer surface of the downhole tool at the sensitive area, a movable cover operatively connected to the downhole tool and movable relative to the sensitive area, a control unit configured to generate an activation signal, and an activation mechanism operable in response to the activation signal, the activation mechanism configured to move the movable cover relative to the sensitive area from the first position to the second position, wherein the movement of the movable cover from the first position to the second position one of increases or decreases a portion of the sensitive area covered by the movable cover.

20 Claims, 7 Drawing Sheets

(56) References Cited

U.S. PATENT DOCUMENTS 4,549,613 A * 10/1985 Case ..... E21B 10/26 175/325.2
5,079,824 A 1/1992 Lopez et al.
5,090,500 A * 2/1992 Yousef ..... E21B 4/14 175/320
5,234,063 A * 8/1993 Collinsworth ..... E21B 17/1078 175/325.2
5,803,193 A 9/1998 Krueger et al.
5,901,798 A 5/1999 Herrera et al.
6,189,612 B1 * 2/2001 Ward ..... E21B 21/08 166/250.07
6,318,465 B1 * 11/2001 Coon ..... E21B 34/12 166/278
6,378,633 B1 4/2002 Moore et al.
7,624,799 B2 12/2009 Myhre et al.
7,669,671 B2 3/2010 Hall et al.
7,740,076 B2 6/2010 Costa et al.
7,918,274 B2 4/2011 Thornton
7,942,199 B2 5/2011 Angman
7,980,331 B2 7/2011 Hall et al.
8,511,377 B2 8/2013 Casassa et al.
9,546,546 B2 1/2017 Haubold et al.
2002/0023782 A1 2/2002 Appleton et al.
2007/0209839 A1 9/2007 Arnoldy
2008/0236819 A1 * 10/2008 Foster ..... E21B 47/0905 166/255.2
2009/0277651 A1 * 11/2009 Kilgore ..... E21B 33/1208 166/387
2013/0118728 A1 5/2013 Didier
2014/0041946 A1 2/2014 Holtzman et al.
2015/0041137 A1 * 2/2015 Rodriguez ..... E21B 4/04 166/301
2015/0226049 A1 * 8/2015 Frangos ..... E21B 44/00 702/6
2016/0017679 A1 1/2016 Jones et al.
2016/0032708 A1 2/2016 Mahjoub et al.
2016/0202381 A1 * 7/2016 Hill ..... G01V 3/18 324/338
2018/0371862 A1 * 12/2018 Lee ..... E21B 33/072

OTHER PUBLICATIONS

International Search Report, International Application No. PCT/US2018/060675, dated Mar. 5, 2019, Korean Intellectual Property Office; International Search Report 3 pages.

International Written Opinion, International Application No. PCT/US2018/060675, dated Mar. 5, 2019, Korean Intellectual Property Office; International Written Opinion 6 pages.

* cited by examiner

DOWNHOLE TOOL PROTECTION COVER

BACKGROUND

1. Field of the Invention

The present invention generally relates to downhole tools, operations, and methods for protecting downhole tools when disposed downhole.

2. Description of the Related Art

Boreholes are drilled deep into the earth for many applications such as carbon dioxide sequestration, geothermal production, and hydrocarbon exploration and production. In all of the applications, the boreholes are drilled such that they pass through or allow access to a material (e.g., a gas or fluid) contained in a formation located below the earth's surface. Different types of tools and instruments may be disposed in the boreholes to perform various tasks and measurements.

For example, to obtain hydrocarbons such as oil and gas, boreholes or wellbores are drilled by rotating a drill bit attached to the bottom of a drilling assembly (also referred to herein as a "Bottom Hole Assembly" or "BHA"). The drilling assembly is attached to tubing, which is usually either a jointed rigid pipe or flexible spoolable tubing commonly referred to in the art as "coiled tubing." The string comprising the tubing and the drilling assembly is usually referred to as the "drill string." When jointed pipe is utilized as the tubing, the drill bit is rotated by rotating the jointed pipe from the surface and/or by a mud motor contained in the drilling assembly. In the case of a coiled tubing, the drill bit is rotated by the mud motor. During drilling, a drilling fluid (also referred to as "mud") is supplied under pressure into the tubing. The drilling fluid passes through the drilling assembly and then discharges at the drill bit bottom. The drilling fluid provides lubrication to the drill bit and carries to the surface rock pieces disintegrated by the drill bit in drilling the wellbore, commonly referred to as the cuttings. The mud motor is rotated by the drilling fluid passing through the drilling assembly. A drive shaft connected to the motor and the drill bit rotates the drill bit.

During wellbore operations, downhole tools with sensitive outer parts and/or equipment can be subjected to mechanical influences, such as rotation, vibration, axial and lateral shocks, stick slip, bending, wall contact, grinding, abrasion, chipping and cuttings and/or chemical influences resulting from contact with the mud. Prior to operation, downhole tools may be subjected to electromagnetic radiation, chemical influences (e.g., varying work environments), and/or mechanical impacts, such as during transportation on the ground. The present disclosure addresses the need to protect these sensitive parts and equipment.

SUMMARY

Disclosed herein are systems and methods for covering sensitive areas of downhole tools including a downhole tool having an outer surface including a first position and a second position on the outer surface of the downhole tool, the outer surface having a sensitive area, a downhole sensitive element positioned along the outer surface of the downhole tool at the sensitive area, a movable cover operatively connected to the downhole tool and movable relative to the sensitive area, a control unit configured to generate an activation signal, and an activation mechanism operable in response to the activation signal, the activation mechanism configured to move the movable cover relative to the sensitive area from the first position to the second position, wherein the movement of the movable cover from the first position to the second position one of increases or decreases a portion of the sensitive area covered by the movable cover.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION

Figure 1:
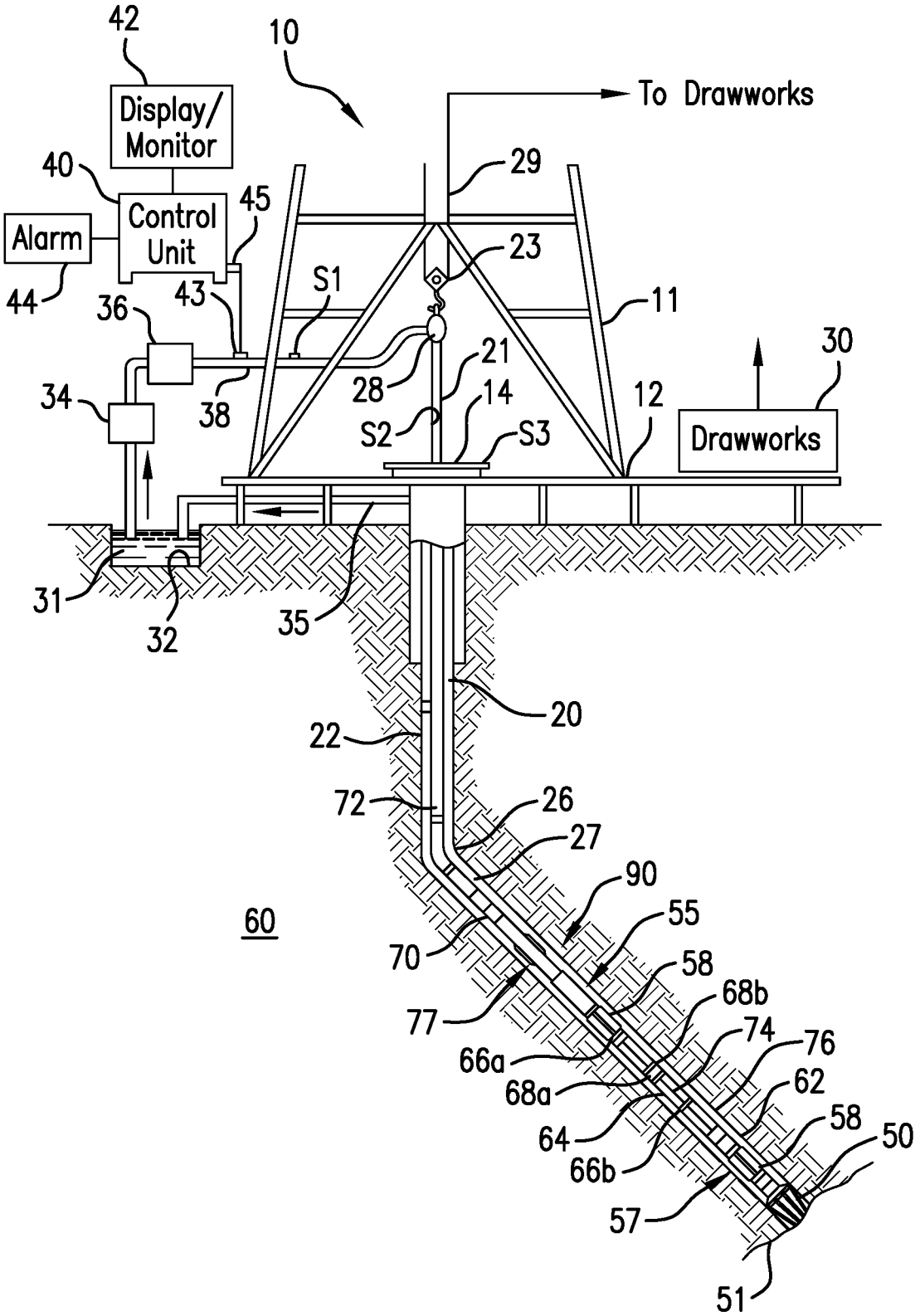
FIG. 1 is an example of a system for performing downhole operations that can employ embodiments of the present disclosure.

FIG. 1 shows a schematic illustration of a system for performing downhole operations that can employ embodiments of the present disclosure. As shown, the system is a drilling system 10 that includes a drill string 20 having a drilling assembly 90, also referred to as a bottomhole assembly (BHA), conveyed in a borehole 26 penetrating an earth formation 60. The drilling system 10 includes a conventional derrick 11 erected on a floor 12 that supports a rotary table 14 that is rotated by a prime mover, such as an electric motor (not shown), at a desired rotational speed. Alternative means to rotating the drill string may be a top drive. The drill string 20 includes a drilling tubular 22, such as a drill pipe, extending downward from the rotary table 14 into the borehole 26. A disintegrating tool 50, such as a drill bit attached to the end of the drilling assembly 90, disintegrates the geological formations when it is rotated to drill the borehole 26. The drill string 20 is coupled to a drawworks 30 via a kelly joint 21, swivel 28 and line 29 through a pulley 23. During the drilling operations, the drawworks 30 is operated to control the weight on bit, which affects the rate of penetration. The operation of the drawworks 30 is well known in the art and is thus not described in detail herein.

During drilling operations a suitable drilling fluid 31 (also referred to as the "mud") from a source or mud pit 32 is circulated under pressure through the drill string 20 by a mud pump 34. The drilling fluid 31 passes into the drill string 20 via a desurger 36, fluid line 38 and the kelly joint 21. The drilling fluid 31 is discharged at the borehole bottom 51 through an opening in the disintegrating tool 50. The drilling fluid 31 circulates uphole through the annular space 27 between the drill string 20 and the borehole 26 and returns to the mud pit 32 via a return line 35. A sensor 51 in the line 38 provides information about the fluid flow rate. A surface torque sensor S2 and a sensor S3 associated with the drill string 20 respectively provide information about the torque and the rotational speed of the drill string. Additionally, one or more sensors (not shown) associated with line 29 are used to provide the hook load of the drill string 20 and about other desired parameters relating to the drilling of the borehole 26. The system may further include one or more downhole sensors 70 located on the drill string 20 and/or the drilling assembly 90.

In some applications the disintegrating tool 50 is rotated by only rotating the drill pipe 22. However, in other applications, a drilling motor 55 (mud motor) disposed in the drilling assembly 90 is used to rotate the disintegrating tool 50 and/or to superimpose or supplement the rotation of the drill string 20. In either case, the rate of penetration (ROP) of the disintegrating tool 50 into the borehole 26 for a given formation and a drilling assembly largely depends upon the weight on bit and the drill bit rotational speed. In one aspect of the embodiment of FIG. 1, the mud motor 55 is coupled to the disintegrating tool 50 via a drive shaft (not shown) disposed in a bearing assembly 57. The mud motor 55 rotates the disintegrating tool 50 when the drilling fluid 31 passes through the mud motor 55 under pressure. The bearing assembly 57 supports the radial and axial forces of the disintegrating tool 50, the downthrust of the drilling motor and the reactive upward loading from the applied weight on bit. Stabilizers 58 coupled to the bearing assembly 57 and other suitable locations act as centralizers for the lowermost portion of the mud motor assembly and other such suitable locations.

A surface control unit 40 receives signals from the downhole sensors 70 and devices via a sensor 43 placed in the fluid line 38 as well as from sensors S1, S2, S3, hook load sensors and any other sensors used in the system and processes such signals according to programmed instructions provided to the surface control unit 40. The surface control unit 40 displays desired drilling parameters and other information on a display/monitor 42 for use by an operator at the rig site to control the drilling operations. The surface control unit 40 contains a computer, memory for storing data, computer programs, models and algorithms accessible to a processor in the computer, a recorder, such as tape unit, memory unit, etc. for recording data and other peripherals. The surface control unit 40 also may include simulation models for use by the computer to processes data according to programmed instructions. The control unit responds to user commands entered through a suitable device, such as a keyboard. The control unit 40 is adapted to activate alarms 44 when certain unsafe or undesirable operating conditions occur.

The drilling assembly 90 also contains other sensors and devices or tools for providing a variety of measurements relating to the formation surrounding the borehole and for drilling the borehole 26 along a desired path. Such devices may include a device for measuring the formation resistivity near and/or in front of the drill bit, a gamma ray device for measuring the formation gamma ray intensity and devices for determining the inclination, azimuth and position of the drill string. A formation resistivity tool 64, made according an embodiment described herein may be coupled at any suitable location, including above a lower kick-off subassembly 62, for estimating or determining the resistivity of the formation near or in front of the disintegrating tool 50 or at other suitable locations. An inclinometer 74 and a gamma ray device 76 may be suitably placed for respectively determining the inclination of the BHA and the formation gamma ray intensity. Any suitable inclinometer and gamma ray device may be utilized. In addition, an azimuth device (not shown), such as a magnetometer or a gyroscopic device, may be utilized to determine the drill string azimuth. Such devices are known in the art and therefore are not described in detail herein. In the above-described exemplary configuration, the mud motor 55 transfers power to the disintegrating tool 50 via a hollow shaft that also enables the drilling fluid to pass from the mud motor 55 to the disintegrating tool 50. In an alternative embodiment of the drill string 20, the mud motor 55 may be coupled below the resistivity measuring device 64 or at any other suitable place.

Still referring to FIG. 1, other logging-while-drilling (LWD) devices (generally denoted herein by numeral 77), such as devices for measuring formation porosity, permeability, density, rock properties, fluid properties, etc. may be placed at suitable locations in the drilling assembly 90 for providing information useful for evaluating the subsurface formations along borehole 26. Such devices may include, but are not limited to, acoustic tools, nuclear tools, nuclear magnetic resonance tools and formation testing and sampling tools.

The above-noted devices transmit data to a downhole telemetry system 72, which in turn transmits the received data uphole to the surface control unit 40. The downhole telemetry system 72 also receives signals and data from the surface control unit 40 and transmits such received signals and data to the appropriate downhole devices. In one aspect, a mud pulse telemetry system may be used to communicate data between the downhole sensors 70 and devices and the surface equipment during drilling operations. A sensor 43, such as a transducer, placed in the mud supply line 38 detects the mud pulses responsive to the data transmitted by the downhole telemetry 72. Sensor 43 generates electrical signals in response to the mud pressure variations and transmits such signals via a conductor 45 to the surface control unit 40. In other aspects, any other suitable telemetry system may be used for two-way data communication between the surface and the drilling assembly 90, including but not limited to, an acoustic telemetry system, an electromagnetic telemetry system, a wireless telemetry system that may utilize repeaters in the drill string or the wellbore and a wired pipe. The wired pipe may be made up by joining drill pipe sections, wherein each pipe section includes a data communication link that runs along the pipe. The data connection between the pipe sections may be made by any suitable method, including but not limited to, hard electrical or optical connections, induction, capacitive or resonant coupling methods. In case a coiled-tubing is used as the drill pipe 22, the data communication link may be run along a side of the coiled-tubing.

The drilling system described thus far relates to those drilling systems that utilize a drill pipe to conveying the drilling assembly 90 into the borehole 26, wherein the weight on bit is controlled from the surface, typically by controlling the operation of the drawworks. However, a large number of the current drilling systems, especially for drilling highly deviated and horizontal wellbores, utilize coiled-tubing for conveying the drilling assembly downhole. In such application a thruster is sometimes deployed in the drill string to provide the desired force on the drill bit. Also, when coiled-tubing is utilized, the tubing is not rotated by a rotary table but instead it is injected into the wellbore by a suitable injector while the downhole motor, such as mud motor 55, rotates the disintegrating tool 50. For offshore drilling, an offshore rig or a vessel is used to support the drilling equipment, including the drill string.

Still referring to FIG. 1, a resistivity tool 64 may be provided that includes, for example, a plurality of antennas including, for example, transmitters 66*a* or 66*b* or and receivers 68*a* or 68*b*. Resistivity can be one formation property that is of interest in making drilling decisions. Those of skill in the art will appreciate that other formation property tools can be employed with or in place of the resistivity tool 64.

Liner drilling can be one configuration or operation used for providing a disintegrating device becomes more and more attractive in the oil and gas industry as it has several advantages compared to conventional drilling. One example of such configuration is shown and described in commonly owned U.S. Pat. No. 9,004,195, entitled "Apparatus and Method for Drilling a Wellbore, Setting a Liner and Cementing the Wellbore During a Single Trip," which is incorporated herein by reference in its entirety. Importantly, despite a relatively low rate of penetration, the time of getting the liner to target is reduced because the liner is run in-hole while drilling the wellbore simultaneously. This may be beneficial in swelling formations where a contraction of the drilled well can hinder an installation of the liner later on. Furthermore, drilling with liner in depleted and unstable reservoirs minimizes the risk that the pipe or drill string will get stuck due to hole collapse.

Although FIG. 1 is shown and described with respect to a drilling operation, those of skill in the art will appreciate that similar configurations, albeit with different components, can be used for performing different downhole operations. For example, wireline, coiled tubing, and/or other configurations can be used as known in the art. Further, production configurations can be employed for extracting and/or injecting materials from/into earth formations. Thus, the present disclosure is not to be limited to drilling operations but can be employed for any appropriate or desired downhole operation(s).

Sensitive areas comprise parts and/or components (hereinafter "downhole sensitive elements") located on the outer surface or diameter of a downhole tool. The downhole tool includes a tool body. The area of the tool body of the downhole tool where the downhole sensitive element(s) is/are located and which is exposed to the external environment of the downhole tool in a borehole is hereinafter referred to as the "sensitive area." The downhole sensitive element in the sensitive areas are exposed to severe conditions while drilling, including thermal, chemical, and/or pressure conditions, as well as exposure to mechanical and/or physical impacts, abrasion, vibration, etc. For example, the downhole sensitive elements may be rotated through a cutting bed, hit borehole wall, be submerged in or otherwise in contact with abrasive fluids, subject to turbulent flows, and/or subject to blasting by abrasive material(s). Accordingly, the downhole sensitive elements should be protected during drilling operations and only exposed to the wellbore when a particular associated functionality is needed. Downhole sensitive elements can include various components including, but not limited to, tools, sensors, electronic devices, mechanical devices, recesses, packers, delicate surfaces (e.g., coated surfaces), sensor windows, etc. that may be used to perform one or more downhole operations. Those of skill in the art will appreciate that recesses on the outer surface of a downhole tool can cause mechanical blockages of the drill string in the interaction with the borehole wall. The borehole wall is not a smooth surface, but rather may comprise breakouts or edges which can make the drill string hang-up while moving within the borehole. In some embodiments, downhole sensitive elements can include sensors used for formation evaluation measurement. Such sensors can include, but are not limited to resistivity sensors including an electromagnetic transmitter and receiver, an acoustic sensor including an acoustic transmitter and receiver, a Nuclear Magnetic Resonance (NMR) sensor including an electromagnetic transmitter and a magnet, a nuclear sensor and detector, a gamma detector, a pressure sensor, an optical sensor, a formation sampling sensor, and/or a pressure tester containing a nozzle.

In accordance with embodiments of the present disclosure, a movable cover, protective cover, or slidable protective sleeve (hereinafter "movable cover") is used to protect the downhole sensitive elements from the severe external environment(s) and conditions that are present during drilling or other downhole operations (e.g., within a drilled borehole or wellbore). In some embodiments, an exchangeable liner is added to increase a product life of the movable cover or other components/elements. For example, a sealing area of the movable cover (e.g., a sleeve or cover support) can be impacted or otherwise damaged due to abrasion, cuttings, or wall contact (e.g., that would typically affect the downhole sensitive elements) and can be exchanged without any re-work on the tool body.

Embodiments provided herein provide apparatus, systems, and methods of use of downhole tools having a movable cover located to, on-demand, protect or unprotect (e.g., cover/uncover) sensitive areas in a first position and movable to a second position, or vice versa, to increase or decrease a portion of the sensitive area that is exposed to the external environment of the tool body or downhole tool. In accordance with various embodiments, the movable cover can be made of metal, plastic, polyetheretherketone (PEEK), composite material, synthetic material, carbon fiber, glass, ceramics, or other material. When functionality of the downhole sensitive elements is needed, the movable cover can be moved away on demand.

Figure 2A:
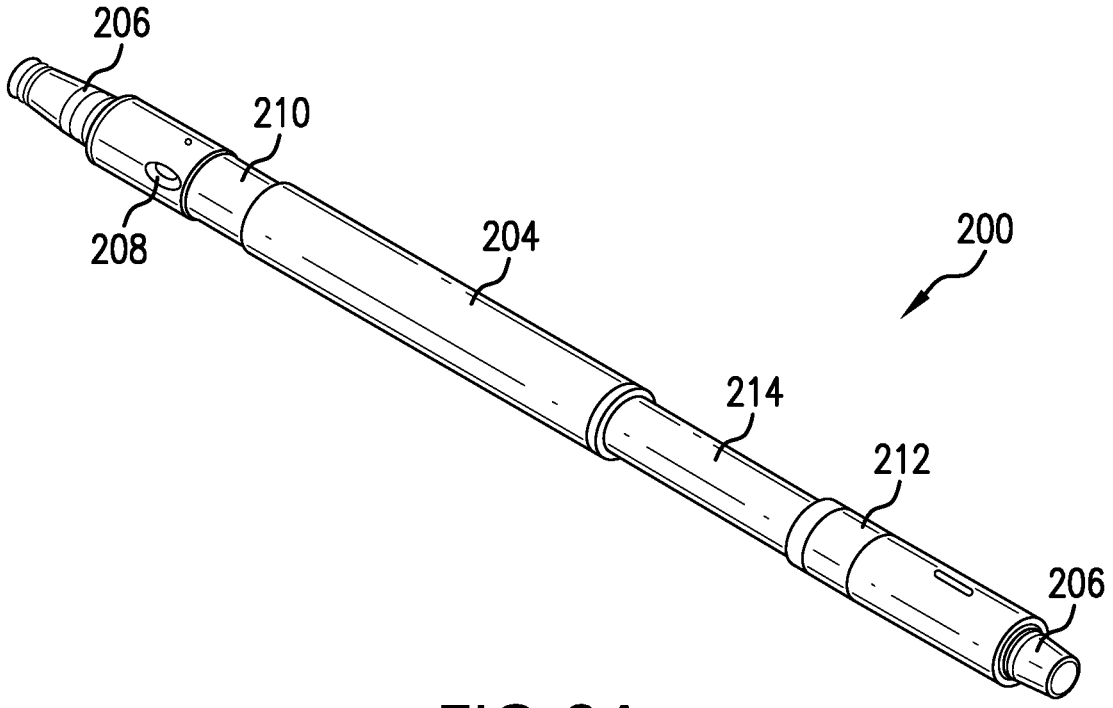
FIG. 2A is a schematic illustration of a downhole tool having a movable cover in accordance with an embodiment of the present disclosure, in a first position.
Figure 2B:
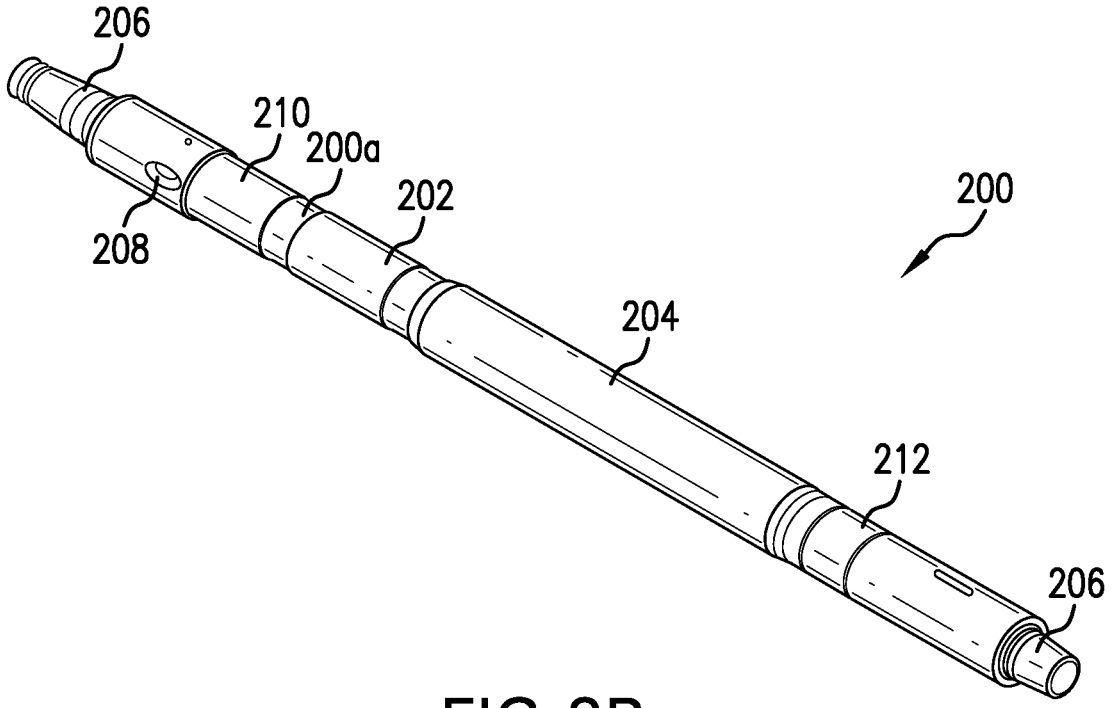
FIG. 2B is a schematic illustration of the downhole tool of FIG. 2A showing the movable cover in a second position.

Turning now to FIGS. 2A-2B, schematic illustrations of a downhole tool 200 having downhole sensitive elements 202 protected by a movable cover 204 in accordance with an embodiment of the present disclosure are shown. FIG. 2A illustrates the downhole tool 200 with the movable cover 204 in a first position. In the first position the movable cover 204 covers and protects the downhole sensitive elements 202 from external environments and conditions located downhole. The downhole tool 200 may be a part of a drill string that is used during drilling operations (e.g., part of drill string 20 shown in FIG. 1). FIG. 2B illustrates the downhole tool 200 with the movable cover 204 in a second position. In the second position the movable cover 204 is moved from the first position and downhole sensitive elements 202 are exposed and able to perform functions associated therewith. The downhole sensitive elements 202 are attached to or at the least exposed from an outer surface 200*a* of the downhole tool 200. It will be understood that the movable cover can be moved from the first position to the second position and back to the first position. Moving of the movable cover changes the portion of the sensitive area that is exposed to the external environment of the tool body. Changing the portion of the sensitive area that is exposed to the external environment of the tool body either increases or decreases the portion of the sensitive area that is exposed to the external environment of the tool body.

The downhole tool 200 can connect to other sections of drill string by one or more connectors 206. Although described herein as attachable to drill string, various other types of downhole systems are possible and able to incorporate embodiments of the present disclosure. For example, the downhole tool of embodiments of the present disclosure (i.e., including a movable cover, slidable protective sleeve, etc.) may be attachable or part of drill string, wireline tools, and/or completion strings without departing from the scope of the present disclosure.

In the present non-limiting embodiment shown in FIGS. 2A-2B, the downhole sensitive element 202 is a packer element. By way of non-limiting example, the packer element may comprise a rubber material. Alternative materials may be textile, fiber, coated materials, metal or Nitril compounds, Ethylene propylene compounds, Fluorocarbon compounds, or any other packer material as will be appreciated by those of skill in the art. As shown in FIG. 2A, the downhole tool 200 includes a mud filter 208, a packer sleeve 210, a limiter 212, and a sleeve support 214. The movable cover 204 is movable (e.g., slidable) along the sleeve support 214. The sleeve support 214 may be a changeable element, such as a liner element, that is replaceable without requiring re-work or other substantial procedures to be performed to replace the sleeve support 214. As shown in FIG. 2A, in the first position, the movable cover 204 and the sleeve support 214 are exposed. As such, during a drilling operation, the movable cover 204 and the sleeve support 214 are subject to downhole environments and conditions (e.g., abrasion, vibration, fluid contact, etc.). When it is desired to operate the downhole sensitive element 202 (e.g., the packer) the movable cover 204 is moved to the second position (FIG. 2B) along the sleeve support 214 and exposes the downhole sensitive elements 202 to the borehole and an operation using the downhole sensitive elements 202 may be performed. For example, in this embodiment, the rubber element of the packer can be expanded into engagement with a borehole wall, as will be appreciated by those of skill in the art.

The packer downhole sensitive element 202 may contain an outer rubber cover which allows sealing of the packer element against a borehole wall. Typically, such packer elements are used for completions applications, as known in the art. In completions applications, the borehole is already drilled the packer element will not be exposed to severe drilling conditions when it is run into the borehole (e.g., post drilling operations). If a packer element was run in the borehole during normal drilling operations, the packer element would likely be damaged or even completely destroyed due to exposure to downhole drilling environmental conditions. As such, rubber covered packer elements have not been used reliably in drilling tools before. That is, the typical while-drilling effects, including but not limited to, abrasion, wall contact, rotation through a cutting bed, etc. would quickly destroy the outer rubber cover and would lead to a failing packer element.

However, as shown in FIG. 2A, in the first position, the movable cover 204 protects the downhole sensitive elements 202. The first position of the movable cover 204 can be employed during a drilling operation, and at a desired time, location, etc. the movable cover 204 can be moved to the second position to expose the downhole sensitive elements 202. The movable cover 204 is designed and arranged to fully cover the downhole sensitive elements 202 while drilling is performed, thus protecting the downhole sensitive elements 202 from the severe drilling conditions. As discussed above, FIG. 1 illustrates downhole sensitive elements 202 (e.g., packer tool) with the sensitive portion(s) (e.g., rubber packer element) fully covered by the movable cover 204. Once the packer is to be activated, the movable cover 204 will be moved into the second position (FIG. 2B), uncovering the downhole sensitive element 202, and allows the downhole sensitive elements 202 to perform a downhole operation (e.g., packer elements expand and seal against a borehole wall). The limiter 212 may be a component or feature that defines a limit of movement or may define the second position of the movable cover 204 (e.g., a stop, a fixed sleeve, a shoulder, a locking, etc.)

To operate or move the movable cover 204 from the first position to the second position (and potentially back to the first position), an activation mechanism is provided within the downhole tool 200. Various types of actuations, activation, and/or operation devices, mechanisms, and/or processes (collectively "activation mechanism") may be employed without departing from the scope of the present disclosure. For example, activation mechanisms in accordance with various embodiments of the present disclosure can include at least one of a hydraulic mechanism, an electromechanical mechanism, an electro-hydraulic mechanism, a pneumatic mechanism, a mechanical mechanism, and a pyrotechnic or explosive mechanism.

Activation and/or operation of the activation mechanisms in accordance with embodiment of the present disclosure can be initiated through down links in order to move the movable cover 204 between first and second positions. For example, various types of downlink that may be employed can include, but is not limited to, mud pulse telemetry, electromagnetic telemetry, wired pipe, acoustic telemetry, optical telemetry, etc. Such downlink can enable controlled activation and movement of the movable cover 204 and thus exposure of the downhole sensitive elements 202. Downlink activation can be achieved automatically, such as built in to a drilling plan, or on demand by an operator. The downlink can be provided from operation of or a signal from a control unit (e.g., control unit 40 shown in FIG. 1).

Further, in some embodiments, automated activation is employed. The automated activation may be activated by meeting a predefined condition, detected by, for example, a sensor in the borehole or at the surface. The automated activation does not require human interaction/initiation (e.g., by transmission of a downlink). In one non-limiting example of such sensor-based activation, a position detection system (such as an LVDT (Linear Variable Differential Transformer)) can be employed to verify the position of the movable cover 204 relative to the downhole sensitive elements 202. An alternative example of such configuration may be a first element located on the tool body (e.g., a sensor, such as a hall sensor or optical sensor) and a second element located on the movable cover 204 (e.g., a detectable element, such as a magnet or a diode). In such embodiments, the sensor may transmit a signal detection to a controller such as the control unit or a processor (e.g., at the surface of downhole in the drill string) to trigger generation of an activation signal to operate the movable cover 204. The activation signal can be, but is not limited to, a pressure variation, an electrical signal, an optical signal, an electromagnetic signal, an acoustic signal, and/or the reception of a drop ball, dart, or RFID chip.

The automated activation may be based on meeting a predefined condition such as an elevated concentration of a monitored chemical element or chemical compound in the borehole (e.g., Methane concentration, oil concentration or other hydrocarbon concentrations, $H_2S$, etc.). Other activation options contemplated herein include a pressure drop or increase of a drilling mud or drilling fluid losses, the detection of a specific depth reached by drilling, or stopped rotation of a drill string. Further, the automated activation may involve a downlink which may be created automatically at the surface based on the predefined condition being met. Alternatively, the activation may be performed entirely downhole. A downhole sensor may detect the predefined condition, and the information about the predefined condition being met is transmitted to a control element (e.g., a processor) in the drill string. In response to the transmitted information from the sensor, the activation signal is sent to the activation mechanism which activates or operates the movable cover.

The activation of the movable cover 204 can be achieved through receipt of an activation signal at the movable cover 204 or an activation mechanism that is arranged to control movement of the movable cover 204. In some embodiment, the activation signal can be transmitted from a control unit that is located at the surface (e.g., control unit 40 shown in FIG. 1) or from a control unit that is located in a BHA or other part of a string that supports the downhole tool 200 or even a control element (e.g., the processor) that is housed within and/or is part of the downhole tool 200 that has the movable cover 204. Generation of an activation signal to actuate or move the movable cover 204 can be made in response to a downlink or may be triggered by a predefined condition (e.g., a measured depth, stopping of a drilling operation (end to rotation of the drill string), changing environmental condition detected (e.g., a hydrocarbon kick is detected), etc.).

Whether performed on demand or automatically, embodiments provided herein enable a movable cover that can be activated (moved) and deactivated (stop; or move back) based on instructions of operation. For example, movement of movable covers of the present disclosure can be activated through command(s) transmitted (downlink) to the downhole tool from surface components (e.g., control units, processors, computers, etc.). Downlinking can be achieved through various mechanisms, including, but not limited to, dropping a ball or dart or an RFID chip, mud pulse telemetry (MPT), electromagnetic telemetry (EMT), acoustic telemetry, optical telemetry, and/or commands transmitted through wired pipe telemetry (WPT). Some of the downlinking methods used herein can enable multiple and/or repeated activation and deactivation of the movable covers and/or controlled movement of the movable covers—e.g., partial opening, closing, staggered or times opening (from first to second position), etc. In case of a partial opening or closing of the movable cover, only a portion of the sensitive area is covered or uncovered, respectively, to protect or unprotect the portion of the sensitive area from the external environment of the downhole tool.

As shown in FIGS. 2A-2B, the movable cover 204 may be a cylindrical sleeve (e.g., entire circumference) and wrapped about the downhole tool 200 to protect the downhole sensitive elements 202 when in the first position. In some embodiments, movable covers in accordance with the present disclosure may be partial cylinder (e.g., wrapped around only a portion of the downhole tool). Further, although shown in FIGS. 2A-2B as movement along an axis of the downhole tool 200 (e.g., parallel or axial movement) in other embodiments, operation of the movable cover may be circumferential or tangential movement (e.g., rotation about the axis of the tool body). In some embodiments, such as circumferential movement of the movable cover, the movable cover may cover less than an entire circumference of the downhole tool (e.g., a partial cylindrical form). In other embodiments, the movable cover may be a complete, hollow cylinder. In other embodiments, the movable cover may be at least partially plane with no curvature or cylindrical form.

In some embodiments, a two-way communication can be provided to enable feedback on a position (or relative position) of the movable cover. Further, in some embodiments, an end switch can be installed at a fully open position (e.g., second position) to provide information regarding an open/closed state of the movable cover. Referring to FIGS. 2A-2B, the end switch could be installed on or near the limiter 212 (or be a part thereof). Alternatively, or in combination therewith, a position sensor, such as a linear variable differential transformer (LVDT) can be provided to measure or detect a position of the movable cover. In some embodiments, referring again to FIGS. 2A-2B, the sleeve support 214 can include a detectable element (or detecting element) and as the movable cover 204 is moved relative to the sleeve support 214 the relative position of the movable cover 204 can be detected. In alternative embodiments, the position of the movable cover relative to the sensitive element may be measured indirectly via the activation mechanisms, such as using the transmission function of a motor or using a gear or lever or any other means to use mechanical or electromechanical relationships of displacement and position. In some embodiments, such precise detection of the position of the movable cover 204 can enable opening or movement of the movable cover 204 to different positions or at different stages (cascaded) along the length of the sleeve support 214.

As noted, in some embodiments, the movement of the movable cover can be monitored with accuracy. Such movements can be provided with a confirmation of whether a desired position is reached. As noted, an end switch can be used to determine if the movable cover is fully in the second position (e.g., fully opened). The end switch can be an electrical or optical switch or contact that enables transmission of a signal from the downhole tool to the surface to provide confirmation of full activation to the fully open. The same holds true for a full deactivation to the fully closed position. In some non-limiting embodiments, the end position may be detected indirectly by observing forces acting on the limiter or by changing pressure conditions in a hydraulic system that may be used in the activation mechanism. In other embodiments, variable moving (opening) distances of the movable cover can be controlled and monitored. That is, the movable cover can be arranged to be capable of moving to any position between the fully closed position and the fully open position. For example, it might be of interest to not fully expose the downhole sensitive element, but only a portion of the sensitive area which is protected by the movable cover. Such capability may be important for various devices and/or sensors which may be protected by that movable cover. In one non-limiting example, more than one device or sensor can be protected by the movable cover (e.g., multiple devices/elements/sensors, etc. that are housed beneath the movable cover). In such instances, an operator or drilling plan may be desired to require operation or use of some subset of the downhole sensitive elements within the downhole tool. Further, in some arrangements, the movable cover may be movable in both directions (e.g., in both directions along the sleeve support) and thus an operation to uncover the downhole sensitive elements can be performed and subsequently a covering operation performed to protect the downhole sensitive elements again or vice versa.

In some non-limiting embodiments, the downhole sensitive element may comprise more than one packer. The multiple packers may be used to isolate an area of the annulus surrounding the downhole tool for the purpose of, for example, performing formation integrity tests, formation sampling tests, formation pressure tests, and/or performing fracking operations. Alternatively, in some embodiments, the downhole sensitive element may be a sensor and it may be of interest to cover or uncover only a part of the sensor (e.g. for controlling sensitivity, etc.).

In some embodiments, the movable cover may be split into more than one movable portion/cover. In such embodiments, the multiple movable covers may be moved together (jointly) or separately (e.g., in time) and may be moved in the same or different directions relative to the tool body. For example, the movable cover may be split into two halves which move in opposite directions relative to the tool body to uncover or cover a sensitive area. In another embodiment the sensitive area may comprise more than one packer and the movable cover is arranged to only uncover or cover one of the multiple packers, while the other packers remain uncovered. In such embodiments, the covered packer can be protected and saved for later use in case one of the uncovered packers fails or wears or (i.e., enabling a spare packer or contingency packer). The same concepts may be realized with the sensitive elements being sensors. One part of the split movable cover may uncover or cover only a portion of the sensor while another portion of the split movable cover protects or covers another portion of the sensor (i.e., providing a spare sensor(s)). Yet another embodiment may involve a hole, a slit, a mesh, or any other shaped opening in the movable cover. While moving the movable cover, the shaped opening moves and uncovers a portion of the sensitive area which is supposed to be exposed to the external environment of the tool body, such as the borehole fluid or the geological formation. Such embodiments may be beneficial with sensors, such as a slotted sensor (e.g., antennas) incorporated in the tool body. By non-limiting example, such sensors are typically used with resistivity tools or NMR tools. In the case of a slotted antenna, the movable cover may include slits. In order to expose the antenna and make it operable, the moveable cover may be moved circumferentially or axially with respect to the axis of the downhole tool in order to move the slits of the movable cover to be at the same circumferential position as the slots of the slotted antenna. Alternatively, any kind of hole shape may be employed with movable covers of the present disclosure, with such features employed to expose a similarly shaped portion of the sensitive area by moving the shaped hole to the correct position either by an axial or circumferential movement or combinations thereof.

Figure 3A:
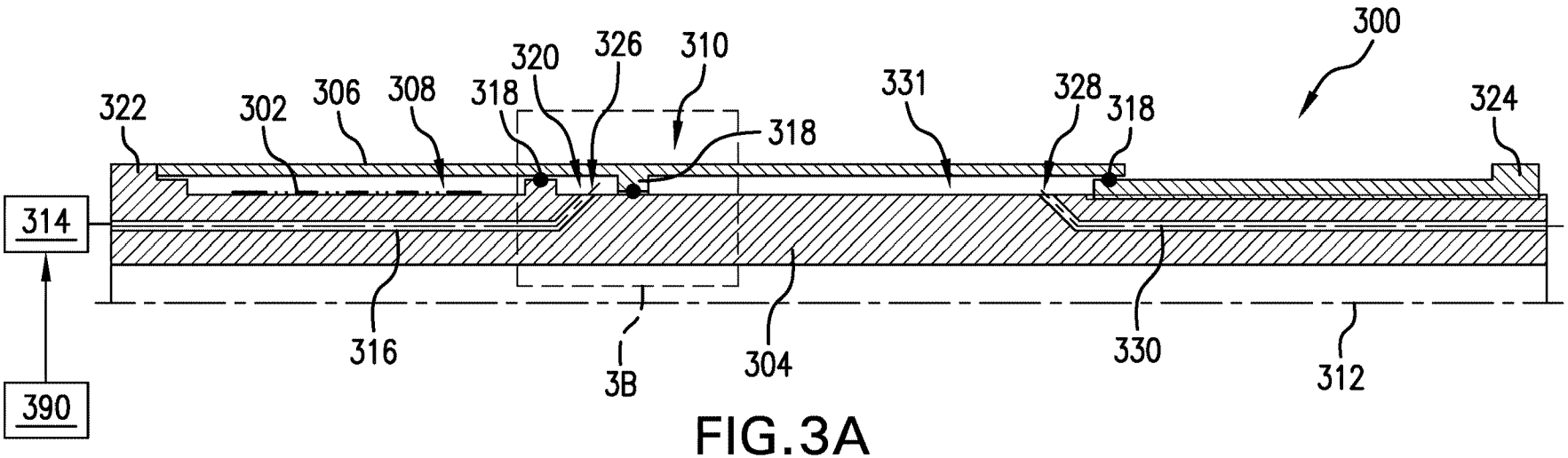
FIG. 3A is a partial cross-sectional illustration of a downhole tool having a movable cover and activation mechanism in accordance with an embodiment of the present disclosure.
Figure 3B:
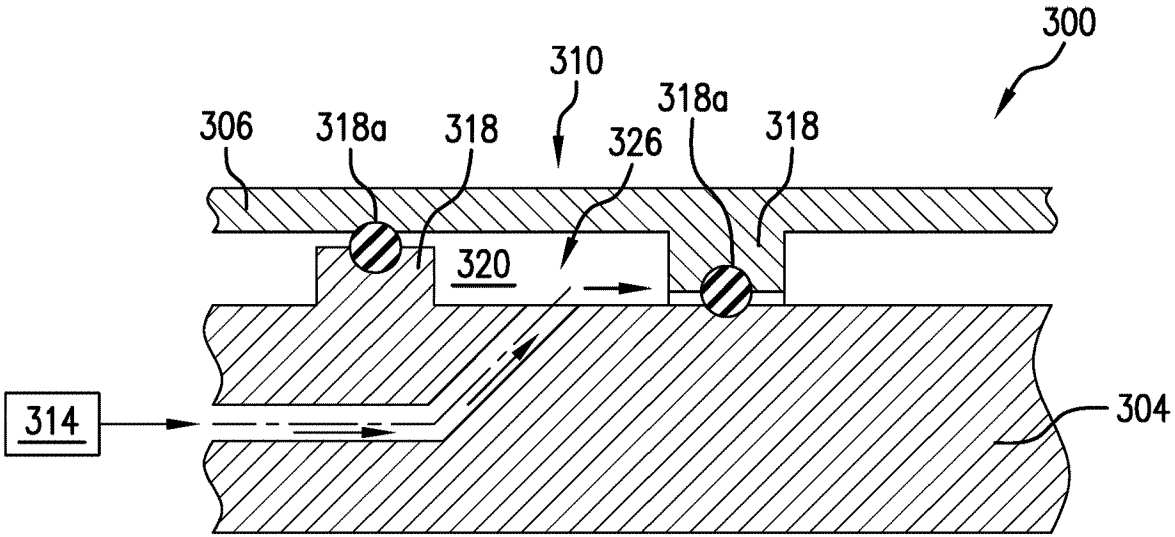
FIG. 3B is an enlarged illustration of the activation mechanism shown in FIG. 3A.

Turning now to FIGS. 3A-3B, schematic illustrations of an activating mechanism in accordance with an embodiment of the present disclosure are shown. As shown in FIGS. 3A-3B, a downhole tool 300 includes downhole sensitive elements 302 mounted to a tool body 304 and protected by a movable cover 306. FIG. 3A illustrates the downhole tool 300 with the movable cover 306 in a first position, such that the downhole sensitive elements 302 are housed within a protective cavity 308 defined by a portion of the movable cover 306 and the tool body 304. In the first position the movable cover 306 covers and protects the downhole sensitive elements 302 from downhole environments and conditions. The downhole tool 300, similar to that shown and described above, may be a part of a drill string that is used during drilling operations (e.g., part of drill string 20 shown in FIG. 1). FIG. 3B illustrates an enlarged illustration, indicated as 3B in FIG. 3A, of an activation mechanism 310 that is arranged to move the movable cover 306 from a first position (shown in FIG. 3A) to a second position that uncovers or exposes the downhole sensitive element 302 to a borehole (e.g., as shown in FIGS. 2A-2B). FIGS. 3A-3B are half-sectional illustrations (of a cylinder) of the downhole tool 300, with the downhole tool having a tool axis 312.

In the embodiment of FIGS. 3A-3B, the activation mechanism 310 is operated through stand pipe pressure and includes a piston or diaphragm that is connected to or part of the movable cover 306. For example, a valve 314 (e.g., electro-mechanical, hydraulic, etc.) is controllable to open a port between an activation fluid line 316 to enable operation and/or movement of the movable cover 306. The valve may be located in the drill string. The stand pipe pressure within the activation fluid line 316 will act on the activation mechanism 310 to move the movable cover 306. In some embodiments, drilling mud or other fluid (e.g., oil) can be used as a hydraulic fluid that applies pressure to the activation mechanism 310. One or more separators 318 can define an activation cavity 320, as shown in FIGS. 3A-3B. The separators 318 and a portion of the movable cover 306 define the activation cavity 320. In some embodiments, the separators 318 can define an operable component that is separate from (e.g., not integrally formed with) the movable cover 306. In this embodiment, the separators 318 are formed as piston or diaphragm elements. Further, in some embodiments, seals 318*a* (shown in FIG. 3B) may be located between the separators 318 and the outer surface of the tool body 304 and can be arranged to prevent external fluids that are within the borehole from entering the activation cavity 320. This will prevent debris or other materials that are within the borehole from interfering with operations of the activation mechanism 310 and/or the movable cover 306.

The movement of the movable cover 306 relative to the tool body 304 can be bounded by one or more limiters 322, 324. For example, as shown in FIG. 3A, a first limiter 322 and a second limiter 324 are positioned or arranged to stop movement of the movable cover 306. As shown in FIG. 3A, when the movable cover 306 is in the first position, the movable cover 306 contacts the first limiter 322. Further, as shown in FIG. 3B, the activation mechanism 310 can include one or more seals 318*a* that seal the activation cavity 320. The seals 318*a* may be located between the separator 318 and the outer surface of the tool body 304 and thus seal the activation cavity 320 against the external environment of the downhole tool and the drilling fluid in the borehole to enable operation of the movable cover 306.

As shown, the first limiter 322 is integrally formed with or part of the tool body 304. However, in other embodiments, the first limiter 322 can be a separate element or device that is attached to the tool body 304 (e.g., split shoulder, etc.). The second limiter 324 is positioned to define an open or second position of the movable cover 306. That is, when a hydraulic fluid acts upon the activation mechanism 310 and urges the movable cover 306 from the first position (protecting the downhole sensitive elements 302) to the second position (exposing the downhole sensitive elements 302) the movable cover 306 is stopped from additional movement (thus defining the second, open position).

Although the movable cover 306 can be openable once (e.g., activation when desired to expose the downhole sensitive elements 302), in some embodiments, such as that shown in FIGS. 3A-3B, the movable cover 306 can be activated and deactivated (open and closed) repeatedly. For example, activation fluid can be controlled to provide pressure on the activation mechanism 310 through the activation fluid line 316 and an activation inlet 326 that opens into the activation cavity 320 when the movable cover 306 is in the first position. With the application of the pressure within the activation cavity 320, the movable cover 306 will move toward the second limiter 324 and expose the downhole sensitive elements 302. The second limiter 324 will stop the movement of the movable cover 306 such that the activation cavity 320 of the activation mechanism 310 is positioned over a deactivation inlet 328 that is fluidly connected to a deactivation fluid line 330. If it is desired to protect the downhole sensitive elements 302 after activation and movement of the movable cover 306, a fluid pressure can be provided through the deactivation fluid line 330 and the deactivation inlet 328 and into the activation cavity 320 to thus urge the movable cover 306 toward the first limiter 322. Accordingly, in some embodiments, the movable cover may be opened just one time (e.g., single use/operation) or multiple times opened and closed (e.g., multiple use/operation).

The operation of the movable cover 306 and/or the activation mechanism 310 is achieved through an activation signal that is generated by a control unit 390 that is in operable communication with at least a portion of the activation mechanism 310. For example, in the embodiment shown in FIG. 3A, the control unit 390 may be operably connected to the valve 314 which enables changes in hydraulic pressure within the activation cavity 320. In other embodiments, as described below, a control unit may be directly in communication with one or more elements that are designed to move the movable cover 306.

Figure 4:
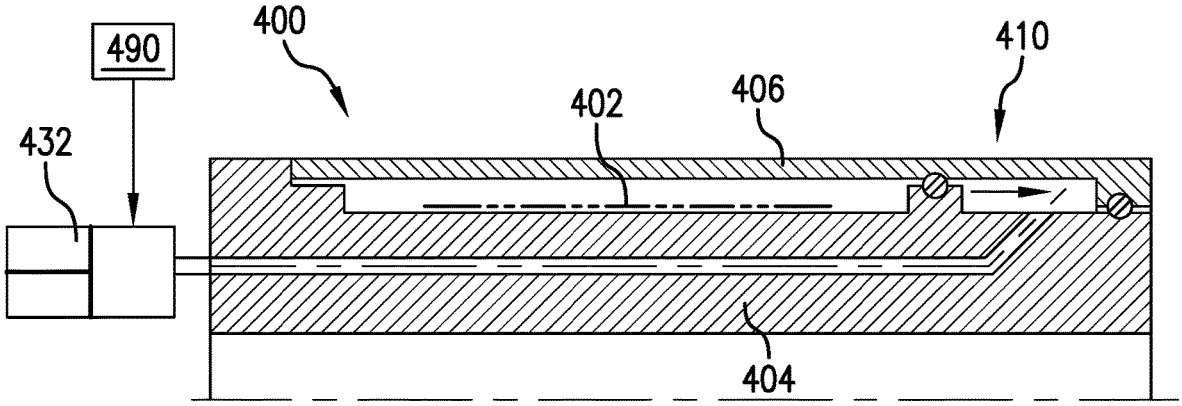
FIG. 4 is a schematic illustration of an activation mechanism in accordance with another embodiment of the present disclosure.

Turning now to FIG. 4, an activation mechanism 410 that is arranged relative to a movable cover 406 and movable along a tool body 404 of a downhole tool 400 is shown. The downhole tool 400 is similar to the arrangements shown and described above, except for operation of the activation mechanism 410. That is, the movable cover 406 is operable to protect downhole sensitive elements 402 when in a first position (shown in FIG. 4) and movable to a second position wherein the downhole sensitive elements 402 are exposed to a borehole. In this embodiment, the activation mechanism 410 is operated through application of pressure from a pump 432 (rather than the stand pipe pressure of FIGS. 3A-3B). The pump 432 may be controlled by a control until 490 that generates an activation signal to operate the pump 432. The control unit 490 may be located downhole or at the surface. As shown, the pump 432 can generate pressure to urge the movable cover 406 to expose the downhole sensitive elements 402. This embodiment will include one or more internal hydraulic system elements with a separate hydraulic fluid to be used to operate the activation mechanism 410 and move the movable cover 406 relative to the tool body 404 and thus expose the downhole sensitive elements 402.

Figure 5:
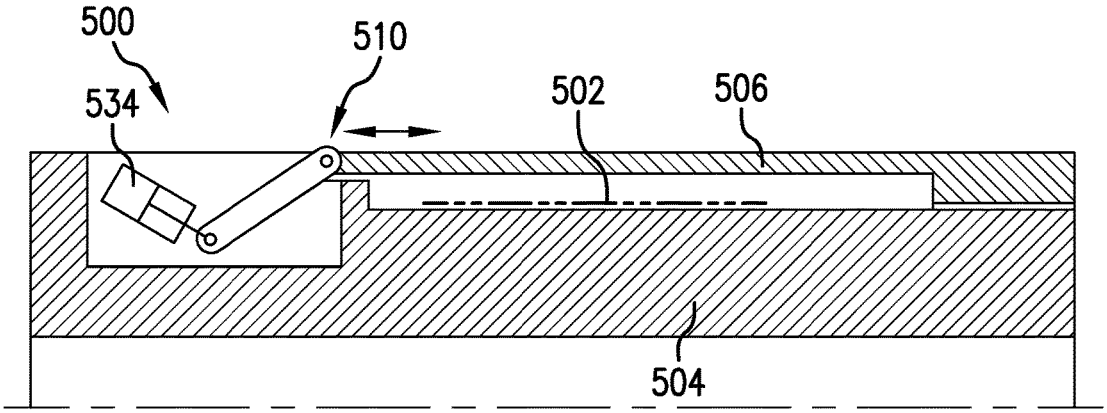
FIG. 5 is a schematic illustration of an activation mechanism in accordance with another embodiment of the present disclosure.

Turning now to FIG. 5, an activation mechanism 510 that is arranged relative to a movable cover 506 that is movable along a tool body 504 of a downhole tool 500 is shown. The downhole tool 500 is similar to the arrangements shown and described above, except for operation of the activation mechanism 510. That is, the movable cover 506 is operable to protect downhole sensitive elements 502 when in a first position (shown in FIG. 5) and movable to a second position wherein the downhole sensitive elements 502 are exposed to a borehole. In this embodiment, the activation mechanism 510 includes an actuator 534 that is coupled to the movable cover 506. In some embodiments, the actuator 534 may be electromechanical, although other types of actuators (e.g., hydraulically activate and operated, etc.) can be employed without departing from the scope of the present disclosure. In operation, on command from a control unit or controller (e.g., at the surface or located within the string or downhole tool 500) the actuator 534 will push or pull on the movable cover 506 to move the movable cover 506 between a first position (closed/protective) and a second position (open/exposed elements). As will be appreciated by those of skill in the art, the activation mechanism 510 having the actuator 534 can be used for multiple activation and de-activation operations.

Figure 6:
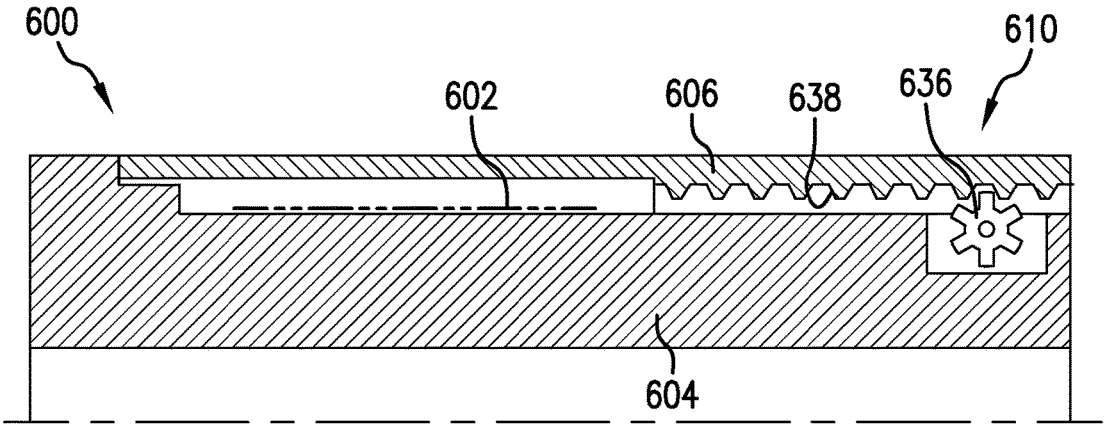
FIG. 6 is a schematic illustration of an activation mechanism in accordance with another embodiment of the present disclosure.

Turning now to FIG. 6, an activation mechanism 610 that is arranged relative to a movable cover 606 that is movable along a tool body 604 of a downhole tool 600 is shown. The downhole tool 600 is similar to the arrangements shown and described above, except for operation of the activation mechanism 610. That is, the movable cover 606 is operable to protect downhole sensitive elements 602 when in a first position (shown in FIG. 6) and movable to a second position wherein the downhole sensitive elements 602 are exposed to a borehole. In this embodiment, the activation mechanism 610 includes a gear 636 that engagable with and is operable to move the movable cover 606. In this embodiment, the movable cover 606 includes teeth 638 that are engagable with the gear 636 to enable movement of the movable cover 606. In operation, on command from a controller (e.g., at the surface or located within the string or downhole tool 600) the gear 636 will rotate and the teeth 638 of the movable cover 606 will force the movable cover 606 to move between a first position (closed/protective) and a second position (open/exposed elements). As will be appreciated by those of skill in the art, the activation mechanism 610 having a gear arrangement can be used for multiple activation and de-activation operations.

Figure 7:
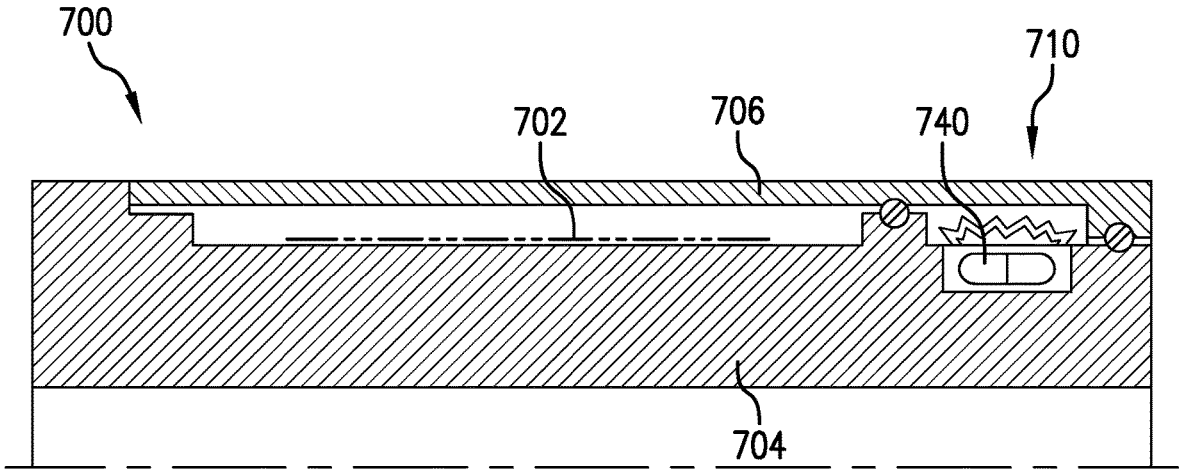
FIG. 7 is a schematic illustration of an activation mechanism in accordance with another embodiment of the present disclosure.

Turning now to FIG. 7, an activation mechanism 710 that is arranged relative to a movable cover 706 that is movable along a tool body 704 of a downhole tool 700 is shown. The downhole tool 700 is similar to the arrangements shown and described above, except for operation of the activation mechanism 710. That is, the movable cover 706 is operable to protect downhole sensitive elements 702 when in a first position (shown in FIG. 7) and movable to a second position wherein the downhole sensitive elements 702 are exposed to a borehole. In this embodiment, the activation mechanism 710 includes an explosive device 740 that arranged to apply a force to the movable cover 706 to move the movable cover 706 from the first position to the second position. For example, use of a chemical or other device can generate a gas heat to expand a gas and thus act to move the movable cover 706. That is, an expanding gas volume will generate the pressure to move the movable cover 706. In some embodiments, multiple explosive devices could be positioned at different locations along the tool body 704 to enable repeated opening and closing of the movable cover 706.

Figure 8:
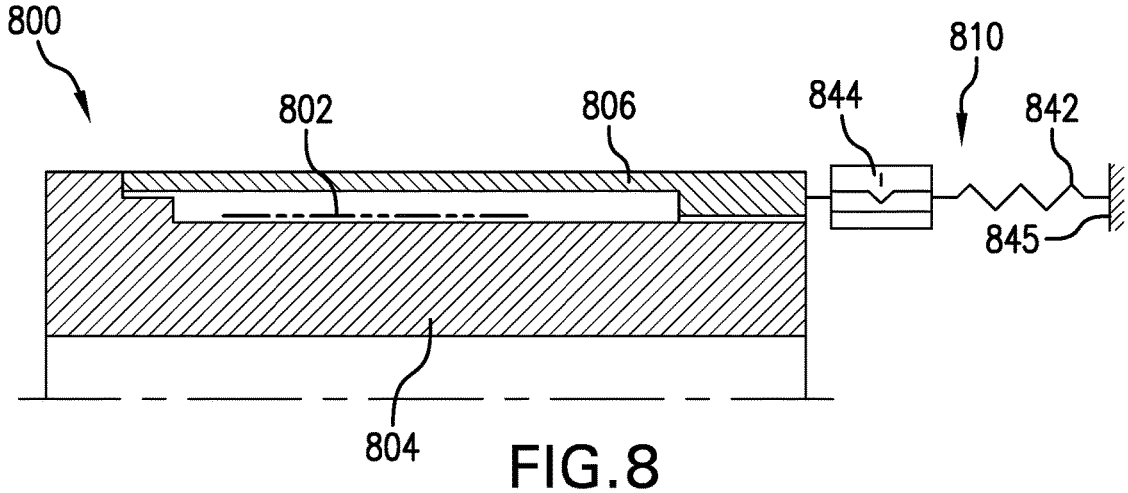
FIG. 8 is a schematic illustration of an activation mechanism in accordance with another embodiment of the present disclosure.

Turning now to FIG. 8, an activation mechanism 810 that is arranged relative to a movable cover 806 that is movable along a tool body 804 of a downhole tool 800 is shown. The downhole tool 800 is similar to the arrangements shown and described above, except for operation of the activation mechanism 810. That is, the movable cover 806 is operable to protect downhole sensitive elements 802 when in a first position (shown in FIG. 8) and movable to a second position wherein the downhole sensitive elements 802 are exposed to a borehole. In this embodiment, the activation mechanism 810 is a spring-loaded system including a spring 842 connected to a fixation or thrust block 845. The spring 842 can be pre-loaded at the surface (e.g., at a time of installation or before disposing downhole) and, on command, the load of the spring 842 can be released to open the movable cover 806. In the illustration of FIG. 8, the spring 842 may be arranged to apply a force in either direction (e.g., toward the first position or toward the second position) depending on desired operation and triggering mechanism. For example, activation of a locking mechanism 844 can be released in order to allow the spring 842 to move the movable cover 806. The spring 842 may apply a force in a direction from the first position toward the second position, and maintained as such by the locking mechanism 844. However, upon releasing the locking mechanism 844, the spring 842 can pull the movable cover 806 from the first position to the second position.

Figure 9:
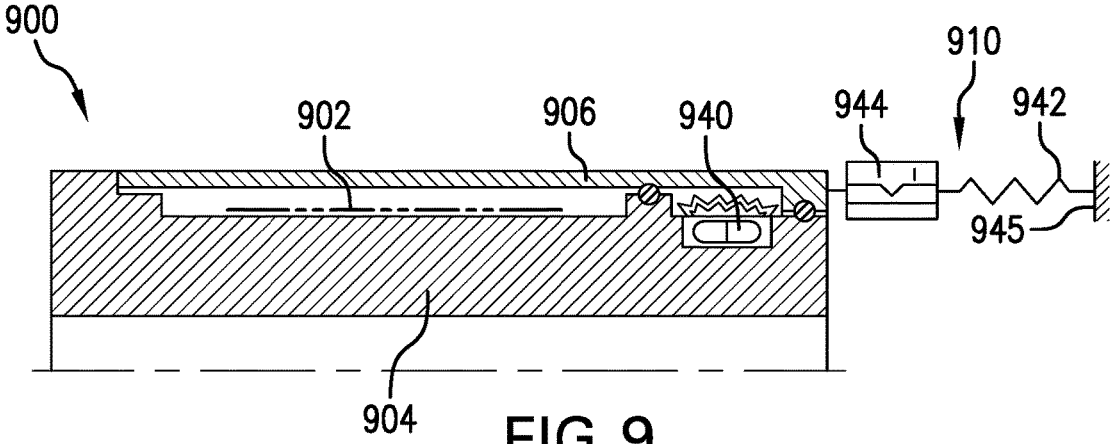
FIG. 9 is a schematic illustration of an activation mechanism in accordance with another embodiment of the present disclosure.

Turning now to FIG. 9, an activation mechanism 910 that is arranged relative to a movable cover 906 that is movable along a tool body 904 of a downhole tool 900 is shown. The downhole tool 900 is similar to the arrangements shown and described above, except for operation of the activation mechanism 910. That is, the movable cover 906 is operable to protect downhole sensitive elements 902 when in a first position (shown in FIG. 9) and movable to a second position wherein the downhole sensitive elements 902 are exposed to a borehole. In this embodiment, the activation mechanism 910 includes a combination of different activation and re-activation elements (e.g., combinations of the above described embodiments). For example, as shown in FIG. 9, the activation mechanism 910 includes an explosive device 940 for an opening operation and a spring 942 is provided to enable a closing operation. In this embodiment, the load of the spring 942 connected to a fixation 945 can be biased to enable pushing the movable cover 906 from the second position (e.g., open) back to the first position (e.g., closed). In the embodiment of FIG. 9, the movable cover 906 is opened with the explosive device 940. While moving from the first position to the second position, the movable cover 906 puts energy into the spring 942 (e.g., compresses the spring 942). In the second position, the spring 942 may be compressed and locked in an end position (e.g., at the second position of the movable cover 906). For deactivation, a locking mechanism 944 will release the spring 942 and the movable cover 906 will be pushed back into the first position. Such activation/deactivation can be achieved multiple times using multiple explosive devices 940 located at one or more positions on the tool body 904.

Referring again to FIG. 3A, for example, the movable cover is movable from the first position to the second position and is movable from the second position back to the first position. To achieve both movements, a multiport valve may be deployed (not shown). To move from the first position to the second position the multiport valve opens a port to the activation fluid line 316 and allows pressurized hydraulic fluid (or drilling mud) to enter the activation cavity. In response to a pressure increase in the activation cavity 320 the movable cover will move from the first position to the second position. To move the movable cover from the second position back to the first position the multiport valve will change the path of the pressurized hydraulic fluid from the activation line 316 to the deactivation line 330 and at the same time will provide a path for the hydraulic fluid to leave the activation cavity 320. In response to the hydraulic fluid entering the deactivation cavity 331 the movable cover will move in the opposite direction and, thus, will move from the second position to the first position.

Figure 10:
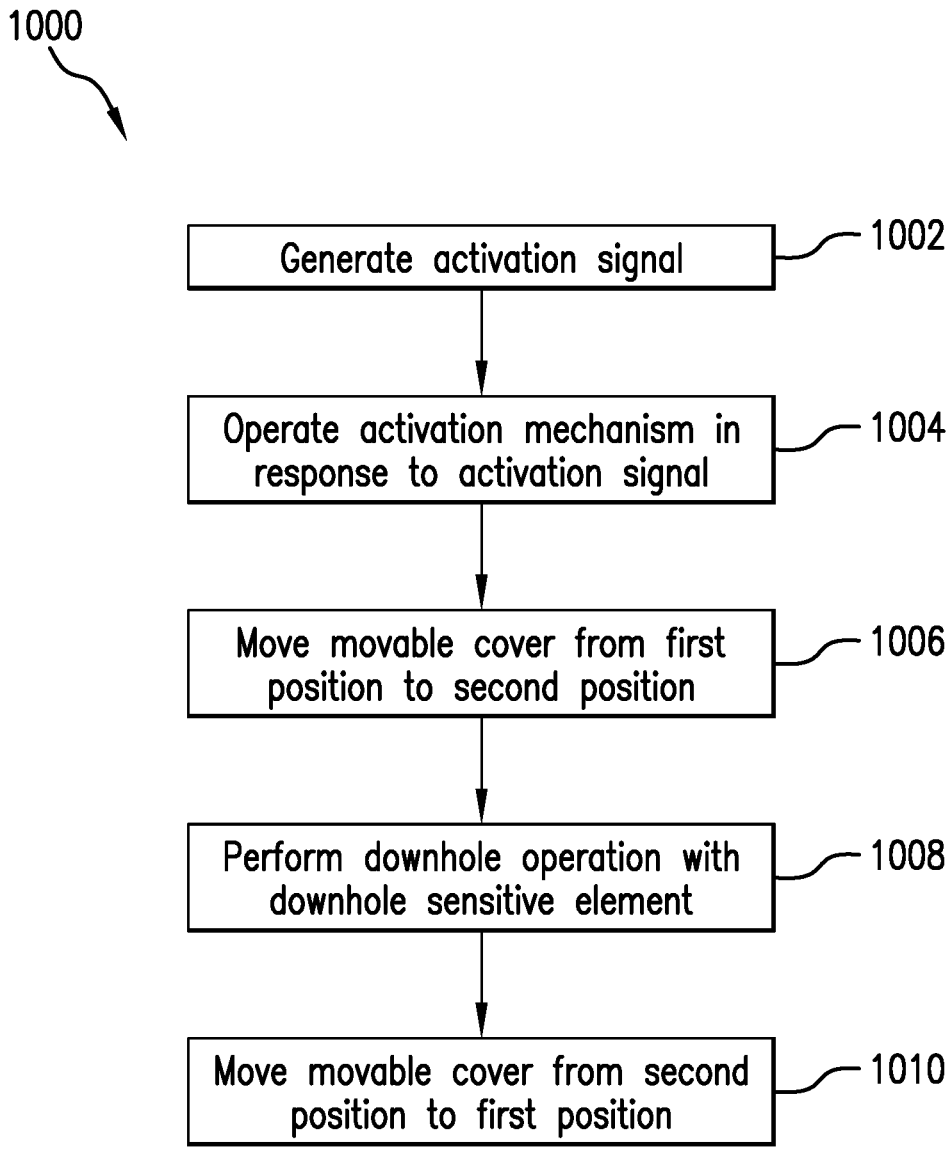
FIG. 10 is a flow process for protecting a downhole sensitive element on a downhole tool in accordance with an embodiment of the present disclosure.

Turning now to FIG. 10, a flow process 1000 in accordance with an embodiment of the present disclosure is shown. The flow process 1000 can be performed using a drilling system such as that shown in FIG. 1 and can incorporate a downhole tool having a movable cover as shown and described herein with respect to the various above described embodiments and/or variations thereof. The movable cover is arranged to protect one or more downhole sensitive elements (sensitive areas) during a drilling operation, but is operable to expose the downhole sensitive elements on demand (e.g., after drilling is completed, when a predefined condition is met, etc.). In some embodiments, activation of the activation mechanism is operated in response to a predefined condition such as, but not limited to, detection of a specific chemical, detection of a specific depth reached by drilling, or stopped rotation of a drill string. A predefined condition can also be the detection of an elevated concentration of a monitored chemical element or chemical compound in the borehole (e.g., methane concentration, oil concentration, and/or other hydrocarbon concentrations, $H_2S$, $CO_2$ concentrations, a pressure drop or increase of the drilling mud or drilling fluid losses, etc.).

At block 1002, when it is desired to expose the downhole sensitive elements, an activation signal is generated. The activation signal can be at least one of a pressure variation, an electrical signal, an optical signal, an electromagnetic signal, an acoustic signal, a radio frequency signal, or the reception of a drop ball, dart, or RFID. In some embodiments, the activation signal can be triggered by a downlink that initiates the activation signal. In some embodiments the downlink and the activation signal can be the same signal (e.g., direct communication from a surface control unit to a portion of an activation mechanism).

At block 1004, in response to the activation signal, an activation mechanism can be operated. The activation mechanism can be at least one of a hydraulic mechanism, an electrical mechanism, an electro-hydraulic mechanism, a pneumatic mechanism, a mechanical mechanism, an electromechanical mechanism, and a pyrotechnic mechanism.

At block 1006, the operation of the activation mechanism moves the movable cover from a first position to a second position, thus exposing the downhole sensitive elements. In some embodiments, block 1006 may include a staggered or partial opening operation. That is, for example, using a geared activation mechanism (or, e.g., a limited amount of hydraulic fluid (pressure) or mud provided to an activation cavity) the movable cover may be opened to some opening that is greater than the first position (closed) and less than the second position (fully opened).

At block 1008, with the downhole sensitive elements exposed, a downhole operation using the downhole sensitive elements can be performed. Such downhole operations can include, but is not limited to, packer/isolation operations, resistivity measurements, sidewall coring operations, gripper engagements, etc.

At block 1010, after finishing the downhole operation, the activation mechanism moves the movable cover from the second position to the first position to cover the sensitive area and the downhole sensitive element again to protect the same from the external environment.

As discussed above, in some embodiments, the movable cover can be moved again from the second position to the first position. In such operation, for example, (i) a drilling operation can be performed, (ii) the drilling may be stopped and the downhole sensitive elements are exposed to perform a specific operation, (iii) the movable cover may be closed to protect the downhole sensitive elements again, and (iv) drilling operations may be resumed. Such process may be repeated multiple times, as desired and/or depending on the specific arrangement of the movable cover and activation mechanism.

In various embodiments of the present disclosure, the movable covers may require a sealing against an outer surface of the tool body. In a while-drilling application, the outer sealing surface is exposed to drilling environment and conditions and may be damaged after a certain time period. An exchangeable liner fixed to the outer tool body could build the sealing surface between tool body and movable cover. The activation cavity is sealed by deploying a dynamic seal between the separator and the sealing surface. The sealing surface may either be the outer surface of the tool body or the outer surface of an exchangeable sleeve or liner fixed to the outer tool body. In case of damage, the liner with the sealing surface can be replaced, without requiring replacement or overhaul of the entire system. In such way the lifetime of the tool body will be increased. Dynamic seals, as known in the art, are seals that retain or separate fluids. Such dynamic seals create a barrier between moving and stationary surfaces in rotary or linear applications, such as rotation shafts, pistons, or movable covers as described herein.

Figure 11:
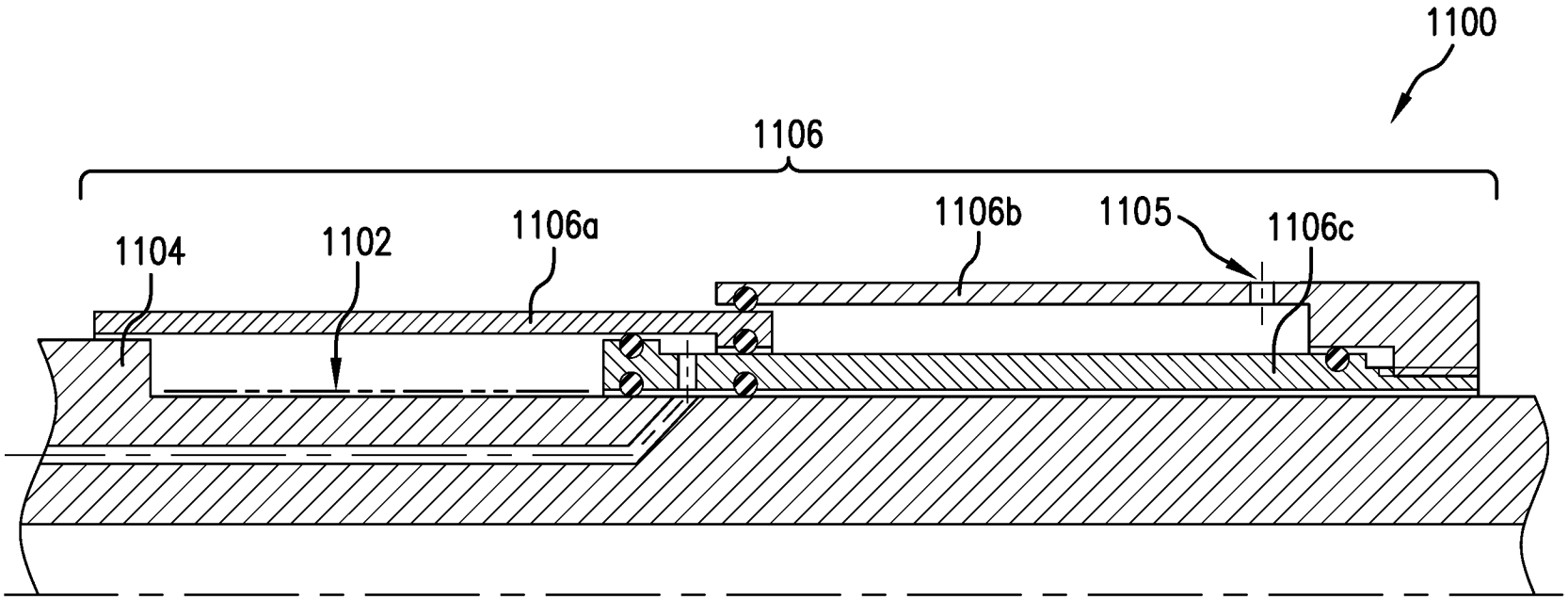
FIG. 11 is a partial cross-sectional illustration of a downhole tool having a movable cover and activation mechanism in accordance with another embodiment of the present disclosure.

Turning now to FIG. 11 a partial cross-sectional illustration of a downhole tool 1100 having a movable cover 1106 and activation mechanism in accordance with another embodiment of the present disclosure. The movable cover 1106 of this embodiment is similar in operation to the above described embodiments, and thus similar features may not be repeated or described above. The movable cover 1106 is arranged on a tool body 1104 to cover a sensitive element 1102 located at a sensitive area. The movable cover 1106 of this embodiments includes multiple cover elements 1106*a*, 1106*b*, 1106*c*. That is, in some embodiments of the present disclosure, the movable cover can be formed of multiple cover elements.

As shown, a first cover element 1106*a* is arranged to cover the sensitive element 1102. The first cover element 1106*a* is retained between a second cover element 1106*b* and a third cover element 1106*c*. The arrangement of the cover elements 1106*a*, 1106*b*, 1106*c* defines an activation cavity (similar to that described above) and can include separators, seals, etc. The multiple cover elements 1106*a*, 1106*b*, 1106*c* can enable the elimination of external sealing surfaces that could be damaged by environmental conditions in the borehole. Further, such arrangements can employ higher forces than other embodiments to move the movable cover between the first and second positions. Moreover, as shown in FIG. 11, the second cover element 1106*b* includes an aperture 1105 that may be a hole, slit, or mesh configuration to enable fluid flow through at least a part of the moveable cover 1006.

Embodiment 1: A system to cover a sensitive area of a downhole tool in a downhole operation in a wellbore comprising: a downhole tool having an outer surface including a first position and a second position on the outer surface of the downhole tool, the outer surface having a sensitive area; a downhole sensitive element positioned along the outer surface of the downhole tool at the sensitive area; a movable cover operatively connected to the downhole tool and movable relative to the sensitive area; a control unit configured to generate an activation signal; and an activation mechanism operable in response to the activation signal, the activation mechanism configured to move the movable cover relative to the sensitive area from the first position to the second position, wherein the movement of the movable cover from the first position to the second position one of increases or decreases a portion of the sensitive area covered by the movable cover.

Embodiment 2: The system according to any embodiment herein, wherein the activation mechanism is at least one of a hydraulic mechanism, an electromechanical mechanism, an electro-hydraulic mechanism, a pneumatic mechanism, a mechanical mechanism, and a pyrotechnic mechanism.

Embodiment 3: The system according to any embodiment herein, wherein the activation mechanism is initiated by a downlink, wherein the downlink comprises at least one of mud pulse telemetry, electromagnetic telemetry, wired pipe telemetry, acoustic telemetry, and optical telemetry.

Embodiment 4: The system according to any embodiment herein, wherein the downhole sensitive element is a sensor.

Embodiment 5: The system according to any embodiment herein, wherein the sensor is at least one of a resistivity sensor, a nuclear sensor, an acoustic sensor, a formation sampling sensor, a pressure sensor, a Nuclear Magnetic Resonance (NMR) sensor, and a gamma detector.

Embodiment 6: The system according to any embodiment herein, wherein the downhole sensitive element is a packer element.

Embodiment 7: The system according to any embodiment herein, wherein the movable cover comprises at least one of a mesh, a slit, or a hole.

Embodiment 8: The system according to any embodiment herein, further comprising a processor, the processor configured to generate the activation signal, wherein the activation signal comprises at least one of an electrical signal, an optical signal, and an electromagnetic signal.

Embodiment 9: The system according to any embodiment herein, further comprising a position detection system, the position detection system detecting the position of the movable cover relative to the sensitive area.

Embodiment 10: The system according to any embodiment herein, wherein the activation mechanism is operated in response to a predefined condition, wherein the predefined condition is detected by a sensor.

Embodiment 11: The system according to any embodiment herein, wherein the movable cover covers at least partially a circumference of the downhole tool.

Embodiment 12: The system according to any embodiment herein, wherein the movement of the movable cover relative to the sensitive area is one of (i) substantially axial with respect to the axis of the downhole tool, (ii) substantially circumferential with respect to the axis of the downhole tool, or (iii) a combination of axial and circumferential with respect to the axis of the downhole tool.

Embodiment 13: The system according to any embodiment herein, wherein the activation signal comprises at least one of a pressure variation, an acoustic signal, and a reception of a drop ball, a dart, or an RFID chip.

Embodiment 14: The system according to any embodiment herein, wherein the movable cover is configured to be moved multiple times.

Embodiment 15: The system according to any embodiment herein, wherein the movable cover comprises two or more cover elements arranged on the downhole tool, wherein at least one of the cover elements is movable relative to the sensitive area.

Embodiment 16: A method to cover sensitive areas of a downhole tool in a downhole operation in a wellbore comprising: generating an activation signal and transmitting said activation signal to an activation mechanism; and operating the activation mechanism to move a movable cover relative to a sensitive area from a first position on the downhole tool to a second position on the downhole tool, wherein the movable cover is operatively connected to the downhole tool and the sensitive area is positioned along the outer surface of the downhole tool, wherein movement of the movable cover from the first position to the second position one of increases or decreases a portion of the sensitive area covered by the movable cover, Embodiment 17: The method according to any embodiment herein, wherein the downhole tool is part of a drill string, the method further comprising stopping a drilling operation before operating the activation mechanism.

Embodiment 18: The method according to any embodiment herein, wherein the activation mechanism is initiated by a downlink.

Embodiment 19: The method according to any embodiment herein, wherein the activation mechanism is operated in response to a predefined condition, the method further comprising detecting the predefined condition using a sensor, wherein the activation signal to activate the activation mechanism is generated without the interaction of a human being.

Embodiment 20: The method according to any embodiment herein, wherein the movable cover comprises two or more cover elements arranged on the downhole tool, wherein at least one of the cover elements is movable relative to the sensitive area.

In support of the teachings herein, various analysis components may be used including a digital and/or an analog system. For example, controllers, computer processing systems, and/or geo-steering systems as provided herein and/or used with embodiments described herein may include digital and/or analog systems. The systems may have components such as processors, storage media, memory, inputs, outputs, communications links (e.g., wired, wireless, optical, or other), user interfaces, software programs, signal processors (e.g., digital or analog) and other such components (e.g., such as resistors, capacitors, inductors, and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (e.g., ROMs, RAMs), optical (e.g., CD-ROMs), or magnetic (e.g., disks, hard drives), or any other type that when executed causes a computer to implement the methods and/or processes described herein. These instructions may provide for equipment operation, control, data collection, analysis and other functions deemed relevant by a system designer, owner, user, or other such personnel, in addition to the functions described in this disclosure. Processed data, such as a result of an implemented method, may be transmitted as a signal via a processor output interface to a signal receiving device. The signal receiving device may be a display monitor or printer for presenting the result to a user. Alternatively or in addition, the signal receiving device may be memory or a storage medium. It will be appreciated that storing the result in memory or the storage medium may transform the memory or storage medium into a new state (i.e., containing the result) from a prior state (i.e., not containing the result). Further, in some embodiments, an alert signal may be transmitted from the processor to a user interface if the result exceeds a threshold value.

Furthermore, various other components may be included and called upon for providing for aspects of the teachings herein. For example, a sensor, transmitter, receiver, transceiver, antenna, controller, optical unit, electrical unit, and/or electromechanical unit may be included in support of the various aspects discussed herein or in support of other functions beyond this disclosure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

As used herein, the term "uphole" means a position or direction that is above a given position, component, part, event, etc. and "downhole" means a position or direction below the given position, component, part, event, etc. That is as a borehole is drilled through the earth, uphole means toward the surface (e.g., a direction opposite a drilling direction relative to the borehole itself) and downhole means toward the furthest extent of the borehole (e.g., the location of a drill bit on a drill string). Uphole positions are positions relative to a given point between the given point and the surface. Downhole positions are positions relative to a given point between the given point and the furthest extent of the borehole (e.g., the drill bit during a drilling operation).

The flow diagram(s) depicted herein is just an example. There may be many variations to this diagram or the steps (or operations) described therein without departing from the scope of the present disclosure. For instance, the steps may be performed in a differing order, or steps may be added, deleted or modified. All of these variations are considered a part of the present disclosure.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the present disclosure.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While embodiments described herein have been described with reference to various embodiments, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed as the best mode contemplated for carrying the described features, but that the present disclosure will include all embodiments falling within the scope of the appended claims.

Accordingly, embodiments of the present disclosure are not to be seen as limited by the foregoing description, but are only limited by the scope of the appended claims.

What is claimed is:

1. A system to cover a sensitive area of a downhole drill string in a downhole drilling operation in a wellbore comprising:

a downhole drill string having an outer surface defining a first position and a second position on the outer surface of the downhole drill string, the outer surface having a sensitive area;

a downhole sensitive element positioned along the outer surface of the downhole drill string at the sensitive area;

a movable cover operatively connected to the downhole drill string and movable relative to the sensitive area, the movable cover being movable along a sleeve support, wherein the sleeve support is a liner fixed to the outer surface of the downhole drill string, wherein the liner is located between the outer surface of the downhole drill string and the movable cover;

a control unit configured to generate an activation signal; and an activation mechanism operable in response to the activation signal, the activation mechanism configured to move the movable cover relative to the sensitive area from the first position to the second position, wherein the movement of the movable cover from the first position to the second position one of increases or decreases a portion of the sensitive area covered by the movable cover.

2. The system of claim 1, wherein the activation mechanism is at least one of a hydraulic mechanism, an electromechanical mechanism, an electro-hydraulic mechanism, a pneumatic mechanism, a mechanical mechanism, and a pyrotechnic mechanism.

3. The system of claim 1, wherein the activation signal is a downlink, wherein the downlink comprises at least one of mud pulse telemetry, electromagnetic telemetry, wired pipe telemetry, acoustic telemetry, and optical telemetry.

4. The system of claim 1, wherein the downhole sensitive element is a sensor.

5. The system of claim 4, wherein the sensor is at least one of a resistivity sensor, a nuclear sensor, an acoustic sensor, a formation sampling sensor, a pressure sensor, a Nuclear Magnetic Resonance (NMR) sensor, and a gamma detector.

6. The system of claim 1, wherein the downhole sensitive element is a packer element.

7. The system of claim 1, wherein the movable cover comprises at least one of a mesh, a slit, or a hole.

8. The system of claim 1, further comprising a processor, the processor configured to generate the activation signal, wherein the activation signal comprises at least one of an electrical signal, an optical signal, and an electromagnetic signal.

9. The system of claim 1, further comprising a position detection system, the position detection system detecting the position of the movable cover relative to the sensitive area.

10. The system of claim 1, wherein the activation signal is generated in response to a predefined condition, wherein the predefined condition is detected by a sensor.

11. The system of claim 1, wherein the movable cover covers at least partially a circumference of the downhole drill string.

12. The system of claim 1, wherein the movement of the movable cover relative to the sensitive area is substantially axial with respect to the axis of the downhole drill string.

13. The system of claim 1, wherein the activation signal comprises at least one of a pressure variation, an acoustic signal, and a reception of a drop ball, a dart, or an RFID chip.

14. The system of claim 1, wherein the movable cover is configured to be moved multiple times.

15. The system of claim 1, wherein the movable cover comprises two or more cover elements arranged on the downhole drill string, wherein at least one of the cover elements is movable relative to the sensitive area.

16. A method to cover sensitive areas of a downhole drill string during a downhole drilling operation in a wellbore comprising:

generating an activation signal and transmitting said activation signal to an activation mechanism; and operating the activation mechanism to move a movable cover relative to a sensitive area from a first position on the downhole drill string to a second position on the downhole drill string, the movable cover being movable along a sleeve support, wherein the sleeve support is a liner fixed to an outer surface of the downhole drill string, wherein the liner is located between the outer surface of the downhole drill string and the movable cover, wherein the movable cover is operatively connected to the downhole drill string and the sensitive area is positioned along the outer surface of the downhole drill string, wherein movement of the movable cover from the first position to the second position one of increases or decreases a portion of the sensitive area covered by the movable cover.

17. The method of claim 16, further comprising stopping the drilling operation before operating the activation mechanism.

18. The method of claim 16, wherein the activation signal is generated in response to a downlink.

19. The method of claim 16, wherein the activation signal is generated in response to a predefined condition, the method further comprising detecting the predefined condition using a sensor, wherein the activation signal to activate the activation mechanism is generated without the interaction of a human being.

20. The method of claim 16, wherein the movable cover comprises two or more cover elements arranged on the downhole drill string, wherein at least one of the cover elements is movable relative to the sensitive area.

* * * * *